US006811300B2

(12) United States Patent
Kamoshida et al.

(10) Patent No.: US 6,811,300 B2
(45) Date of Patent: Nov. 2, 2004

(54) ROTATIONAL SPEED CONTROLLER FOR MIXING EQUIPMENT OF SOIL MODIFYING MACHINE AND ENGINE SPEED CONTROLLER FOR SOIL MODIFYING MACHINE

(75) Inventors: Yasuhiro Kamoshida, Yokosuka (JP); Yasuhiro Yoshida, Kawasaki (JP); Taneaki Fujino, Kawasaki (JP); Katsuhiro Ikegami, Yokohama (JP)

(73) Assignee: Komatsu Ltd. (JP)

( * ) Notice: Subject to any disclaimer, the term of this patent is extended or adjusted under 35 U.S.C. 154(b) by 246 days.

(21) Appl. No.: 10/080,700

(22) Filed: Feb. 25, 2002

(65) Prior Publication Data

US 2002/0126570 A1 Sep. 12, 2002

(30) Foreign Application Priority Data

Mar. 8, 2001 (JP) ..... 2001-064640
Mar. 8, 2001 (JP) ..... 2001-064658

(51) Int. Cl.[7] ..... B01F 13/10

(52) U.S. Cl. ..... 366/132; 241/101.74; 366/142; 366/299; 404/75

(58) Field of Search ..... 366/60, 132, 142, 366/249, 292, 295, 299, 601; 241/101.74, 152.2; 404/75, 76, 90, 91, 92

(56) References Cited

U.S. PATENT DOCUMENTS 5,782,559 A 7/1998 Neier et al. ..... 366/279
5,988,937 A * 11/1999 Komoriya et al. ..... 404/90
6,000,641 A 12/1999 Komoriya et al. ..... 241/29
6,004,023 A 12/1999 Koyanagi et al. ..... 366/17
6,183,159 B1 * 2/2001 Hashimoto et al. ..... 404/76

FOREIGN PATENT DOCUMENTS

DE 4436659 4/1995

OTHER PUBLICATIONS

Komatsu Ltd. Technical Document, Published Oct., 2000 (Japan).

European Search Report May 29, 2002.

* cited by examiner

*Primary Examiner*—Joseph Drodge
(74) *Attorney, Agent, or Firm*—Rader, Fishman & Grauer PLLC

(57) ABSTRACT

A rotational speed controller for mixing equipment of a soil modifying machine, by which optional quality of modified soil can be obtained, is provided. To this end, the rotational speed controller includes a mixer (127, 147) rotating to mix soil to be modified, drive means (127*b*, 147*b*) for rotationally driving the mixer, speed control means (127*p*, 147*p*) for controlling rotational speed of the drive means based on an inputted rotational speed command value (S127, S147), working mode setting means (8) for outputting a working mode signal (H, M, L, S) for setting a kind of soil to be modified, and a controller (106) for outputting the rotational speed command value corresponding to the working mode signal to the speed control means.

14 Claims, 9 Drawing Sheets

FIG. 2

110

110a

WHEN Sm=ON AND Ss=OFF

| | H | M | L | S |
|---|---|---|---|---|
| SOIL CUTTER ROTATIONAL SPEED Ns | a10 | a20 | a30 | a40 |
| ROTARY HAMMER ROTATIONAL SPEED Nr | b10 | b20 | b30 | b40 |

110b

WHEN Sm=ON AND Ss=ON

| | H | M | L | S |
|---|---|---|---|---|
| SOIL CUTTER ROTATIONAL SPEED Ns | a40 | a40 | a40 | a40 |
| ROTARY HAMMER ROTATIONAL SPEED Nr | b10 | b20 | b30 | b40 |

110c

WHEN Sm=OFF

| | H | M | L | S |
|---|---|---|---|---|
| SOIL CUTTER ROTATIONAL SPEED Ns | 0 | 0 | 0 | 0 |
| ROTARY HAMMER ROTATIONAL SPEED Nr | 0 | 0 | 0 | 0 |

FIG. 6A

FIRST CIRCUIT GROUP

| ACTUATOR | | H | M | L | S |
|---|---|---|---|---|---|
| FIRST ROTARY HAMMER 27 | PRESENCE OF RAW SOIL | a1 | b1 | c1 | d1 |
| | ABSENCE OF RAW SOIL | a2 | b2 | c2 | d2 |
| SECOND ROTARY HAMMER 28 | PRESENCE OF RAW SOIL | a3 | b3 | c3 | d3 |
| | ABSENCE OF RAW SOIL | a4 | b4 | c4 | d4 |
| THIRD ROTARY HAMMER 29 | PRESENCE OF RAW SOIL | a5 | b5 | c5 | d5 |
| | ABSENCE OF RAW SOIL | a6 | b6 | c6 | d6 |
| FEED BELT CONVEYOR 30 | | a7 | b7 | c7 | d7 |
| CRANE 31 | | a8 | b8 | c8 | d8 |
| VIBRATING SIEVE 32 | | a9 | b9 | c9 | d9 |

FIG. 6B

SECOND CIRCUIT GROUP

| ACTUATOR | | H | M | L | S |
|---|---|---|---|---|---|
| SOIL CUTTER 47 | PRESENCE OF RAW SOIL | e1 | f1 | g1 | h1 |
| | ABSENCE OF RAW SOIL | e2 | f2 | g2 | h2 |
| SOLIDIFYING MATERIAL FEEDER 48 | PRESENCE OF RAW SOIL | e3 | f3 | g3 | h3 |
| | ABSENCE OF RAW SOIL | e4 | f4 | g4 | h4 |
| RAKING ROTOR 49 | | e5 | f5 | g5 | h5 |
| DISCHARGE BELT CONVEYOR 50 | | e6 | f6 | g6 | h6 |
| SECONDARY BELT CONVEYOR 51 | | e7 | f7 | g7 | h7 |
| TERTIARY BELT CONVEYOR 52 | | e8 | f8 | g8 | h8 |
| AIR COMPRESSOR 53 | | e9 | f9 | g9 | h9 |

ROTATIONAL SPEED CONTROLLER FOR MIXING EQUIPMENT OF SOIL MODIFYING MACHINE AND ENGINE SPEED CONTROLLER FOR SOIL MODIFYING MACHINE

TECHNICAL FIELD

The present invention relates to a rotational speed controller for mixing equipment of a soil modifying machine and an engine speed controller for a soil modifying machine.

BACKGROUND ART

Recently, soil modifying machines for modifying soil at a site to reuse soil occurring during construction are often used. FIG. 8 shows a self-propelled soil modifying machine 1 as an example (for example, documents issued by Komatsu Ltd.). Soil, which is thrown into a raw soil hopper 16 by a loader such as a hydraulic shovel (not shown), is made to be of a predetermined thickness by a raking rotor 149 while being transported on a feed belt conveyor 130 and passes under a solidifying material hopper 2. When the soil is on the feed belt conveyor 130, a solidifying material feeder 148 is opened and solidifying materials are poured into the soil from the solidifying material hopper 2. The soil and the solidifying materials fall onto a discharge belt conveyor 150 while being cut and mixed with a soil cutter 147 serving as a rotating rotary cutting mixer provided in the vicinity of a conveyor outlet of the feed belt conveyor 130. When falling, grain diameters of soil covered with the solidifying materials become smaller by an impact of a rotary hammer 127 serving as a rotary impact mixer that is rotating. The soil mixed with the solidifying materials is transport outside the machine with the discharge belt conveyor 150. The soil modifying machine 1 moves between sites by traveling equipment 3. The oil cutter 147 and the rotary hammer 127 are each called a mixer, and two of them, collectively, are called mixing equipment.

However, the above soil modifying machine 1 has the following disadvantage. The soil cuter 147 and the rotary hammer 127 are driven by a hydraulic motor, and since a change-over valve for feeding pressure oil to the hydraulic motor is an on-off valve, for which a flow rate control cannot be performed, the rotational speed of the hydraulic motor is zero, or a predetermined value set in advance. Consequently, when a kind of earth to be modified is changed, a desired grain diameter of modified soil can hardly be obtained, and thus it is difficult to obtain quality of modified soil corresponding to a purpose of use.

Next, the self-propelled soil modifying machine 1 according to a prior art will be explained with FIG. 9A and FIG. 9B. Soil thrown into the raw soil hopper 16 by a loader such as a hydraulic shovel (not shown) is made to be of a predetermined thickness by a raking rotor 49 while being transported on a feed belt conveyor 30 and passed under the solidifying material hopper 2. When soil is on the feed belt conveyor 30, a solidifying material feeder 48 is opened and solidifying materials are poured into the soil from the solidifying hopper 2. The soil and the solidifying materials fall onto a discharge belt conveyor 50 while being cut and mixed with a soil cutter 47 provided in the vicinity of a conveyor outlet of the feed belt conveyor 30. When falling, a grain diameter of soil covered with the solidifying materials become smaller by an impact of a rotary hammers 27, 28 and 29. The soil mixed with the solidifying materials are transported outside the machine by the discharge belt conveyor 50. A crane 31 is used when the solidifying materials are replenished to the solidifying material hopper 2. The soil modifying machine 1 moves between sites by the traveling equipment 3.

The soil cutter 47 and the rotary hammers 27, 28 and 29 are collectively called a mixer. The feed belt conveyor 30, the crane 31, the solidifying material feeder 48, the raking rotor 49 and the discharge belt conveyor 50 are collectively called a standard working machine. As an optional working machine, included are an air compressor 53, which is used at a time of cleaning, a secondary and a tertiary belt conveyors 51 and 52 for transporting mixed soil to a place at a predetermined distance from the soil modifying machine 1, and a vibrating sieve 32 for further selecting finer soil from the mixed soil. The mixer, the standard working machine, the optional working machine, and the traveling equipment 3 are all driven by an engine 4.

However, the above soil modifying machine 1 has the following disadvantages. An operator selects the working machine to use from the mixer, the standard working machine and the optional working machine, and the operator performs a fine operation to set the working speed of an actuator of the working machine to use, for each soil and operation content. At this time, the operator performs an operation with the engine 4 always set at full throttle because it is troublesome to frequently adjust engine throttle according to the kind of the working machine to be operated and working speed. However, even when a small number of working machines are operated, and the required power is as small as in the case in which an operating speed is low, an engine speed is large, and thus causing the disadvantage of noise and vibration being large. In addition, there arises the disadvantage of fuel economy being poor.

SUMMARY OF THE INVENTION

The present invention is made in view of the above-described disadvantages, and its first object is to provide a rotational speed controller for mixing equipment of a soil modifying machine, by which optional quality of modified soil can be obtained. A second object of the present invention is to provide an engine speed controller for a soil modifying machine, which reduces noise and vibration of the engine and has excellent fuel economy.

In order to attain the above-described objects, the rotational speed controller for the mixing equipment of the soil modifying machine according to the present invention is a rotational speed controller for mixing equipment of a soil modifying machine for mixing and modifying soil to be modified, and has a constitution including

- a mixer rotating to mix soil to be modified,
- drive means for rotationally driving the mixer, speed control means for controlling rotational speed of the drive means based on an inputted rotational speed command value,
- working mode setting means for outputting an working mode signal for setting a kind of soil to be modified, and
- a controller for outputting the rotational speed command value corresponding to the working mode signal to the speed control means.

According to the above constitution, the kind of soil to be modified can be set by the working mode setting means, and therefore modified soil modified by the soil modifying machine always has a predetermined grain diameter. When only a degree of loosening soil to be modified is desired as quality of modified soil, the mixer is set at a lower rotational speed, and when modified soil with a fine grain diameter is desired, it is set at a higher rotational speed. Since the grain diameter of modified soil can be optionally set in this manner irrespective of the kind of soil to be modified, the rotational speed controller, by which quality corresponding to a use purpose can be selected, can be provided. Since the rotational speed of the mixer can be controlled according to the kind of soil to be modified and always driven at a necessary and sufficient rotational speed, abrasion speed of the mixer can be reduced and replacement cycle of the mixer becomes longer, thus operation cost can be reduced. Further, quality of modified soil can be set only by operating the working mode setting means, and therefor the soil modifying machine the operation of which is simplified and which has excellent operation feeling can be provided.

Further, in the rotational speed controller may have the constitution in which a plurality of the mixers are included, and the controller controls rotational speeds of a plurality of the mixers according to the rotational speed command values corresponding to the individual working mode signals of a plurality of the mixers.

According to the above constitution, a plurality of the mixers are included and the rotational speed is controlled according to each of the mixers, thus making it possible to set a grain diameter of modified soil minutely.

Further, in the rotational speed controller, the working mode setting means may have the constitution including a plurality of selection switches for setting the kind of soil to be modified.

According to the above constitution, the working mode setting means has a plurality of selection switches, and therefore a grain diameter of modified soil can be minutely obtained correspondingly to the operated selection switch.

Further, in the rotational speed controller, the controller may have the constitution in which it has a rotational speed table in which the individual rotational speed command values of a plurality of the mixers corresponding to a plurality of the selection switches are previously stored, and outputs the rotational speed command values, which are obtained from the rotational speed table correspondingly to any selected switch out of a plurality of the selection switches, to the speed control means.

According to the above constitution, in the rotational speed table, rotational speeds at which the quality of modified soil is confirmed by, for example, a test with the soil modifying machine, are set, and therefore the modified soil always and surely has a predetermined grain diameter.

Further, in the rotational speed controller, a plurality of the mixers may have the constitution in which they are a rotary cutting mixer for mixing soil to be modified with a cutter for cutting it, and a rotary impact mixer for mixing soil to be modified by giving it an impact with a hammer.

According to the above constitution, it has the rotary cutting mixer and the rotary impact mixer, and thus modified soil always and certainly has a predetermined grain diameter irrespective of the quality and grain diameter size of the soil to be modified.

A first aspect of an engine speed controller for a soil modifying machine according to the present invention, has a constitution including mixers for mixing soil to be modified and working machines other than the mixers, which are provided at the soil modifying machine, operation means for outputting operation signals to activate and deactivate at least the mixers of the soil modifying machine, an engine for supplying driving power for at least the mixers of the soil modifying machine, governor control means for controlling engine speed based on an inputted command value, and a controller for outputting command values based on the operation signals to the governor control means.

According to the above constitution, the governor control means is controlled based on the operation signals outputted from the operation means for activating and deactivating the working machines of the soil modifying machine. Consequently, for example, during halts of the mixers of the soil modifying machine, the engine speed is set to be lower, and thus the engine speed controller for the soil modifying machine with noise and vibration being reduced with excellent fuel economy can be obtained.

A second aspect of the engine speed controller for the soil modifying machine according to the present invention has a constitution including mixers for mixing soil to be modified and at least one of working machines for mixing around the mixers, which are provided at the soil modifying machine, operation means for outputting operation signals to activate and deactivate the mixers and each of the working machines, a pump having a plurality of hydraulic pumps for supplying pressure oil to each of a plurality of groups into which a plurality of hydraulic actuators driving the mixers and the working machines are divided, and driven by an engine, governor control means for controlling engine speed based on an inputted command value, and a controller for totaling pressure oil flow rates required by the hydraulic actuators operated based on the operation signals according to a plurality of the groups, computing a command value corresponding to engine speed according to a maximum required flow rate out of the totaled values, and outputting it to the governor control means.

According to the above constitution, based on the operation signals outputted from the operation means, the required flow rates of each of the groups are totaled, and the rotational speed of the engine for driving a plurality of hydraulic pumps for driving each of the groups is controlled according to the maximum value of a plurality of totaled values. As a result, each of the hydraulic pumps can secure the flow rate required by each of the groups, the mixers and the peripheral working machines which are to be operated can be surely operated. In addition, since the engine speed is controlled according to the kind of mixers and working machines to be operated, the engine speed controller for the soil modifying machine with noise and vibration being reduced with excellent fuel economy can be obtained.

Further, the engine speed controller may have the constitution including working mode setting means for outputting an working mode signal for setting a kind of soil to be modified, and the constitution in which the controller computes a command value to the governor control means according to the working mode signal and the operation signals, or when totaling required pressure oil flow rates according to a plurality of the groups, the controller totals them based on the working mode signal and the operation signals.

According to the above constitution, the operation speed of the mixers and the working machines is set according to the working mode signals and the operation signals set by the operator. As a result, the operation speed of the mixers and working machines to be operated, corresponding to the kind of soil to be modified, can be obtained, and thus the soil after modification can always obtain a predetermined fixed grain size and quality.

A third aspect of the engine speed controller for the soil modifying machine according to the present invention has a constitution including mixers for mixing soil to be modified and at least one of working machines for mixing around the mixers, which are provided at the soil modifying machine, operation means for outputting operation signals to activate and deactivate the mixers and each of the working machines, a pump having a plurality of hydraulic pumps for supplying pressure oil to each of a plurality of groups into which a plurality of hydraulic actuators driving the mixers and the working machines are divided, and driven by an engine, working mode setting means for outputting a working mode signal for setting a kind of soil to be modified, governor control means for controlling engine speed based on an inputted command value, and a controller for previously storing an engine control curve expressing relationship between discharge flow rates of a plurality of the hydraulic pumps and engine speed, and the constitution in which the controller totals pressure oil flow rates required by the hydraulic actuators corresponding to the working mode signal and the operation signals according to a plurality of the groups, obtains engine speed corresponding to a maximum required flow rate out of the totaled values from the engine control curve, and outputs a command value corresponding to the obtained engine speed to the governor control means.

According to the above constitution, based on the engine control curve previously stored, the engine speed to be set is obtained from the required flow rates obtained according to the working mode signal and the operation signals. Since the engine control curve is the curve for which the performance is confirmed by the test of the actual soil modifying machine, the engine speed for securing the required flow rate can be surely obtained.

Further, in the engine speed controller, the working mode setting means may have the constitution in which it has a plurality of selection switches corresponding to the working mode signals.

According to the above constitution, the working mode setting means has a plurality of selection switches, and thus the kind of soil to be modified can be minutely set. Accordingly, the required flow rate can be minutely set, and the engine outputs only required speed, and therefore the engine speed controller for the soil modifying machine with noise and vibration being reduced with excellent fuel economy can be obtained.

BRIEF DESCRIPTION OF THE DRAWINGS

FIG. 2 is an explanatory diagram of rotational speed tables according to the first embodiment;

FIG. 6A and FIG. 6B are explanatory diagrams of required flow rate operation tables according to the second embodiment, FIG. 6A shows a required flow rate of each actuator of a first circuit group, and FIG. 6B shows a required flow rate of each actuator of a second circuit group;

BEST MODE FOR CARRYING OUT THE INVENTION

Figure 8:
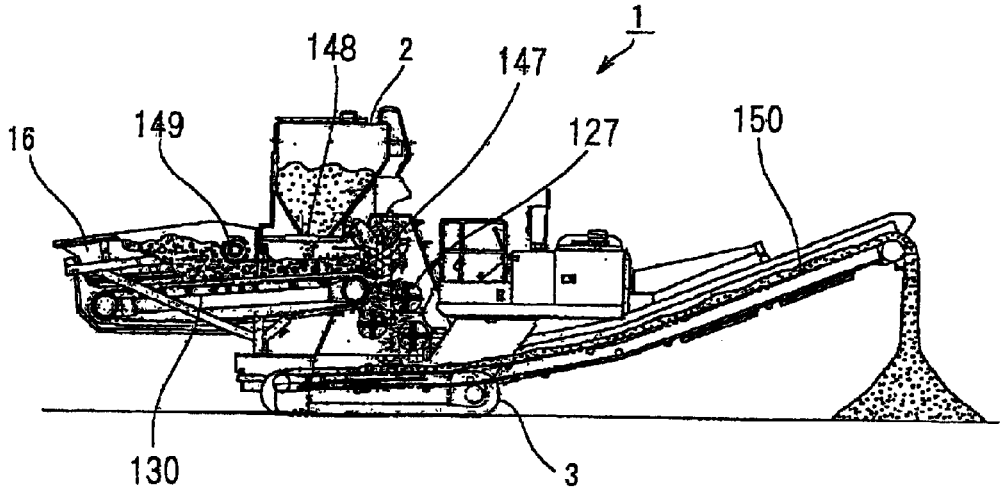
FIG. 8 Prior Art
FIG. 8 is an explanatory view of a soil modifying machine according to a prior art.
Figure 9A:
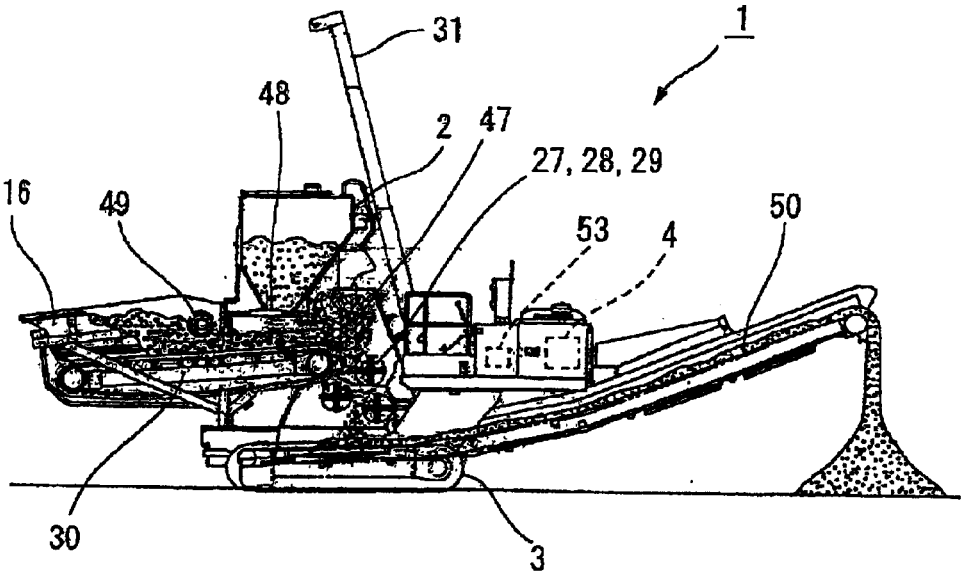
FIG. 9A Prior Art
FIG. 9A is an explanatory view of another soil modifying machine according to the prior art.
Figure 9B:
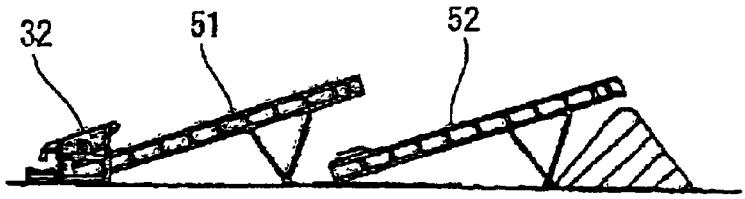
FIG. 9B Prior Art
FIG. 9B is an explanatory view of optional working machines of the soil modifying machine of FIG. 9A.

Preferred embodiments according to the present invention will be explained below with reference to the drawings. The same elements as explained in FIG. 8, FIG. 9A and FIG. 9B are given the identical numerals to make explanation.

Figure 1:
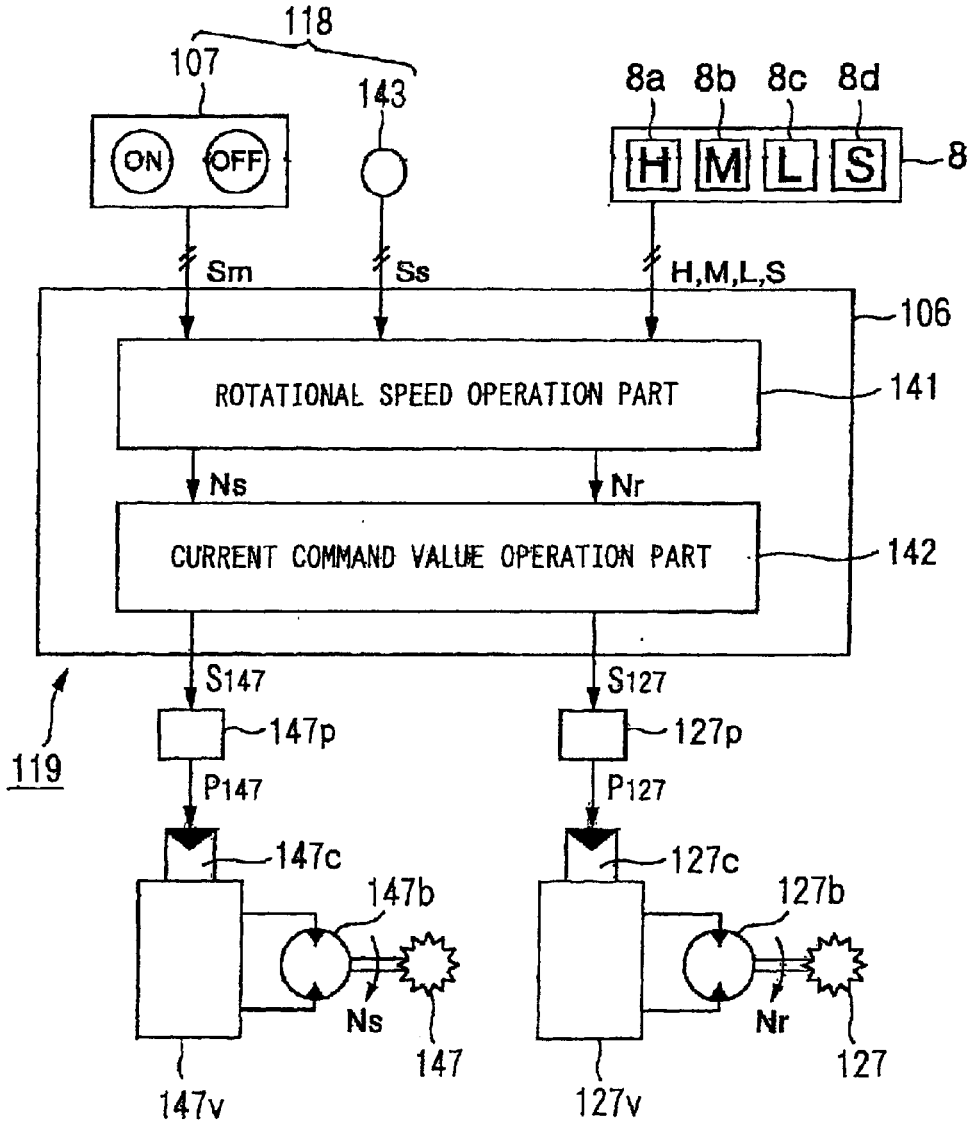
FIG. 1 is a block diagram of a rotational speed controller according to a first embodiment of the present invention.

FIG. 1 shows a constitution of a rotational speed controller 119 according to a first embodiment of the present invention. The rotational speed controller 119 has operating means 118, working mode setting means 8 and a controller 106. The operating means 118 for controlling activation and deactivation of a soil cutter 147 and a rotary hammer 127 has a mixing equipment button 107 and a soil cutter low speed button 143. The mixing equipment button 107 has an on button and an off button, and it outputs to the controller 106 an operation signal Sm to give a command of activation/deactivation of the soil cutter 147 and the rotary hammer 127. When being turned on, the soil cutter low speed button 143 outputs an operation signal Ss to control the soil cutter 147 to a lower rotational speed to the controller 106. The working mode setting means 8 is a switch operated correspondingly to a desired grain diameter of modified soil, and it has selective switches 8*a*, 8*b*, 8*c* and 8*d* respectively for a high mode H, which is selected when a desired grain diameter is small, a middle mode M and a low mode L, which are selected as a desired grain diameter becomes larger, and a sand mode S, which is selected when raw soil has quality with less viscosity as sand. The working mode setting means 8 outputs working mode signals H, M, L and S, which are in the order of the above modes, to the controller 106.

The controller 106 has a rotational speed operation part 141 and a current command value operation part 142. Rotational speed tables 110*a*, 110*b* and 110*c* shown in FIG. 2, each of which shows a soil cutter rotational speed Ns and a rotary hammer rotational speed Nr according to the working mode signals H, M, L and S, are stored in the rotational speed operation part 141 in advance. The rotational speed tables 110*a*, 110*b* and 110*c* respectively show, in this order, the soil cutter rotational speeds Ns and the rotary hammer rotational speeds Nr when the operation signal Sm is on and the operation signal Ss is off, when the operation signal Sm is on and the operation signal Ss is on, and when the operation signal Sm is off. In the rotational speed table 110*a*, the rotational speeds Ns and Nr are a10, a20, a30 and a40, and b10, b20, b30 and b40 in the order of the working mode signals H, M, L and S, which are set to be the maximum value with the working mode signal H and become smaller in the order of H, M, L and S. In the rotational speed table 110*b*, the rotary hammer rotational speed Nr is the same as the Nr of the rotational speed table 110*a*, but the soil cutter rotational speed Ns is set at the same value as with the working mode signal S of the rotational speed table 110*a* regardless of whether the working mode signal is H, M, L or S. In the rotational speed table 110*c*, each of the rotational speed Ns and Nr is set at the zero value.

The current command value operation part 142 computes current command values S147 and S127 as rotational speed command values corresponding to the soil cutter rotational speed Ns and the rotary hammer rotational speed Nr computed in the rotational speed operation part 141. The current command value operation part 142 outputs them to a soil cutter hydraulic control valve 147*p* and a rotary hammer hydraulic control valve 127*p* serving as speed control means which generate oil pressures corresponding to the current command values.

The hydraulic command values P147 and P127 which are outputted from the hydraulic control valves 147*p* and 127*p* respectively, are inputted into pressure receiving parts 147*c* and 127*c* of a soil cutter change-over valve 147*v* and a rotary hammer change-over valve 127*v*. The change-over valves 147*v* and 127*v* opening areas of which are controlled to be values corresponding to the hydraulic command values P147 and P127, communicate with a soil cutter motor 147*b* and a rotary hammer motor 127*b* with hydraulic pipe lines, respectively. The soil cutter 147 and the rotary hammer 127 are attached to rotary parts of the hydraulic motors 147*b* and 127*b*. Each of the change-over valves 147*v* and 127*v* includes a pressure compensating function for always discharging flow corresponding to an opening area irrespective of load pressure. The soil cutter motor 147*b* is called drive means of the soil cutter 147, and the rotary hammer motor 127*b* is called drive means of the rotary hammer 127.

An operation and effects of the rotational speed controller 119 including the above constitution will be explained.

When the mixing equipment button 107 is turned on and the soil cutter low speed button 143 is turned off, the operation signal Sm for on and the operation signal Ss for off are inputted into the controller 106. A grain diameter of modified soil become smaller as the rotational speed of each mixer 147 and 127 is made higher in the order from the working mode signal S to the working mode signal H, and therefore when the selection switch 8*a* of the working mode setting means 8 is turned on to provide a smaller grain diameter, the working mode signal H is inputted into the controller 106. The rotary hammer rotational speed Nr and the soil cutter rotational speed Ns in the column of the working mode signal H shown in the rotational speed table 110*a* of the rotational speed operation part 141 are computed to be b10 and a10, respectively. The current command values S147 and S127 corresponding to the rotational speeds b10 and a10 are computed in the current command value operation part 142 and inputted into the hydraulic control valves 147*p* and 127*p*. Then, the hydraulic control valves 147*p* and 127*p* output the hydraulic command values P147 and P127 to the pressure receiving parts 147*c* and 127*c*, and the change-over valves 147*v* and 127*v* discharge flows corresponding to the hydraulic command values P147 and P127 to the hydraulic motors 147*b* and 127*b*. The hydraulic motors 147*b* and 127*b* to which the mixers 147 and 127 are attached are rotated at the rotational speeds a10 and b10, respectively.

When soil to be modified includes a lot of stones but is loosened, the soil cutter low speed button 143 is turned on. Then, the soil cutter rotational speed Ns and the rotary hammer rotational speed Nr are computed from the table shown in the rotational speed table 110*b*. Specifically, the rotary hammer rotational speed Nr is computed to be lower in the order of the inputted working mode signals H, M, L and S as the rotational speed table 110*a*. However, the soil cutter rotational speed Ns is computed to be a low rotational speed of the working mode signal S. The current command values S147 and S127, which are computed in the current command value operation part 142 according to the inputted speeds Ns and Nr, are inputted into the hydraulic control valves 147*p* and 127*p*. The motors 147*b* and 127*b*, to which the mixers 147 and 127 are attached, are rotated at the speeds Ns and Nr computed with the rotational speed table 110*b*.

When the mixing equipment button 107 is turned off, the soil cutter rotational speed Ns and the rotary hammer rotational speed Nr are computed with the table shown in the rotational speed table 110*c*. Specifically, the rotational speeds Ns and Nr are set at zero value and the rotation of the mixers 147 and 127 are stopped.

As described above, when soil to be modified contains a large amount of, for example, soil with high hardness, or clayey soil, the working mode signal H is selected and the high rotary hammer rotational speed Nr and soil cutter rotational speed Ns are set so that the grain diameter after mixing becomes smaller. When soil to be modified contains a large amount of sandy soil with less viscosity, the working mode signal S is selected and the rotational speeds Ns and Nr are set to be low to reduce abrasion speed of the mixers 147 and 127. When soil to be modified is loosened but contains a large number of stones, the soil cutter low speed button 143 is turned on to decrease the soil cutter rotational speed Ns to reduce abrasion speed of the soil cutter 147. Thus, an operator operates the mixing equipment button 107 and the soil cutter low speed button 143, whereby modified soil have substantially predetermined quality to make it possible to obtain modified soil matching with a use purpose irrespective of the kind of soil to be modified and reduce abrasion of the soil cutter 147 or the rotary hammer 127.

As quality of modified soil, when only loosening soil to be modified is desired, the working mode signal L or S with the small rotational speeds Ns and Nr are selected, and when it is desired to make modified soil with a small grain size, the working mode signal H with the large rotational speeds Ns and Nr are selected, whereby modified soil with an optional grain diameter corresponding to the use purpose is provided. As a result, the rotational speed controller for the mixing equipment of the soil modifying machine, by which modified soil with optional quality can be obtained, is provided.

In the first embodiment, the explanation is made with the mobile soil modifying machine 1 being taken as an example, but it is obvious that the same effects can be exhibited if a stationary soil modifying machine is used instead of the mobile type. In the first embodiment, the selection switch of the working mode setting means 8 has the four levels, that are H, M, L and S, but it may have 2, or 3 levels, or five or more levels. Further, in the first embodiment, the mixers 127 and 147 are driven by the hydraulic motors 127*b* and 147*b*, but they may be driven by electric motors without being limited to the hydraulic ones.

As described above, according to the present invention based on the first embodiment, the mixers are controlled at rotational speeds corresponding to working mode signals to set the kind of soil to be modified, which are outputted from the working mode setting means. As a result, since the kind of soil to be modified can be set, the modified soil, which is modified by the soil modifying machine, always has a predetermined grain diameter, and the percent defective of the modified soil is reduced. When only loosening the soil to be modified is desired as the quality of the modified soil, the mixers are set at a lower rotational speed, and when modified soil with a fine grain size is desired, they are set at a high rotational speed. In this manner, the grain diameter of modified soil can be optionally set irrespective of the kind of soil to be modified, and thus the rotational speed controller, by which the quality corresponding to the use purpose can be selected, can be provided. In addition, since the rotational speed of the mixers can be controlled according to the kind of soil to be modified, and the mixers can be always operated at a necessary and sufficient rotational speed, the abrasion speed of the mixers can be reduced. As a result, the exchange cycle of the mixers is made longer, and therefore the operation cost can be reduced. Further, the quality of the modified soil can be set only by operating the working mode setting means and the soil cutter low speed button, and thus the soil modifying machine requiring only a simple operation and having excellent operation feeling can be obtained.

Figure 3:
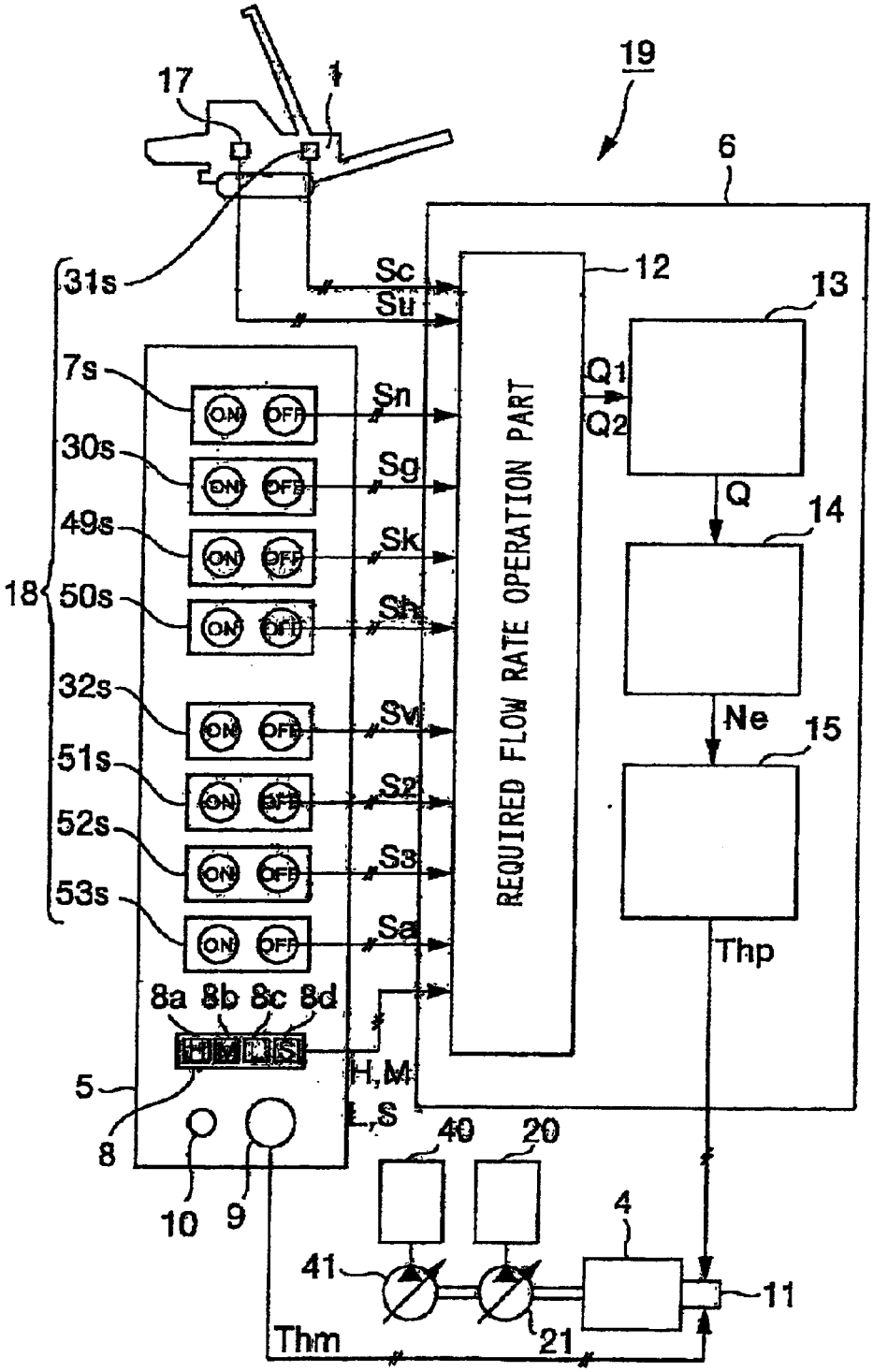
FIG. 3 is a block diagram of an engine speed controller according to a second embodiment of the present invention.

Next, a second embodiment of the present invention will be explained. FIG. 3 shows a constitution of an engine speed controller 19 of the second embodiment. The engine speed controller 19 has an operating panel 5 and a controller 6. The operating panel 5 has a mixer button 7*s*, a feed belt conveyor button 30*s*, a raking rotor button 49*s*, a discharge belt conveyor button 50*s*, a vibrating sieve button 32*s*, a secondary belt conveyor button 51*s*, a tertiary belt conveyor button 52*s*, and an air compressor button 53*s*. Each of the buttons has an on button and an off button, and they output to the controller 6 operation signals Sn, Sg, Sk, Sh, Sv, S2, S3 and Sa to instruct activation and deactivation of the corresponding working machines.

Further, working mode setting means 8, a fuel adjustment dial 9, and an automatic control button 10 are arranged on the operating panel 5. The working mode setting means 8 has selection switches 8*a*, 8*b*, 8*c* and 8*d*, which are switches operated correspondingly to a desired grain diameter of the modified soil, and which correspond to the following modes: a high mode H, which is selected when a desired grain diameter is small, a middle mode M and a low mode L, which are selected as a desired grain diameter becomes larger, and a sand mode S, which is selected when raw soil has quality with less viscosity as sand. Working mode signals H, M, L, and S corresponding to the modes in the above order, are inputted into the controller 6. The fuel adjustment dial 9 outputs a throttle command value Thm corresponding to a dial position to governor control means 11 for adjusting a fuel rate. When the automatic control button 10 is turned on, the engine speed is automatically controlled according to the kinds of the working machines to be operated and the working mode signals H, M, L, or S, and when it is turned off, the engine speed becomes a speed corresponding to the throttle command value Thm.

A raw soil presence and absence switch 17 for detecting whether a feed belt conveyor 30 transports soil or not is attached just at the back of a raking rotor 49. When soil of predetermined thickness or more is thereon, an existence and absence signal Su of on is inputted into the controller 6, and when it is not, the existence and absence signal Su of off is inputted into the controller 6. An operation signal Sc of on at the time of activation of a crane 31, and that of off at the time of deactivation thereof are inputted into the controller 16 from a crane button 31*s* for instructing activation and deactivation of the crane 31.

The mixer button 7*s*, the feed belt conveyor button 30*s*, the raking rotor button 49*s*, the discharge belt conveyor button 5O*s*, the vibrating sieve button 32*s*, the secondary belt conveyor button 51*s*, the tertiary belt conveyor button 52*s*, the air compressor button 53*s*, and the crane button 31*s*are collectively called operation means 18.

Figure 4:
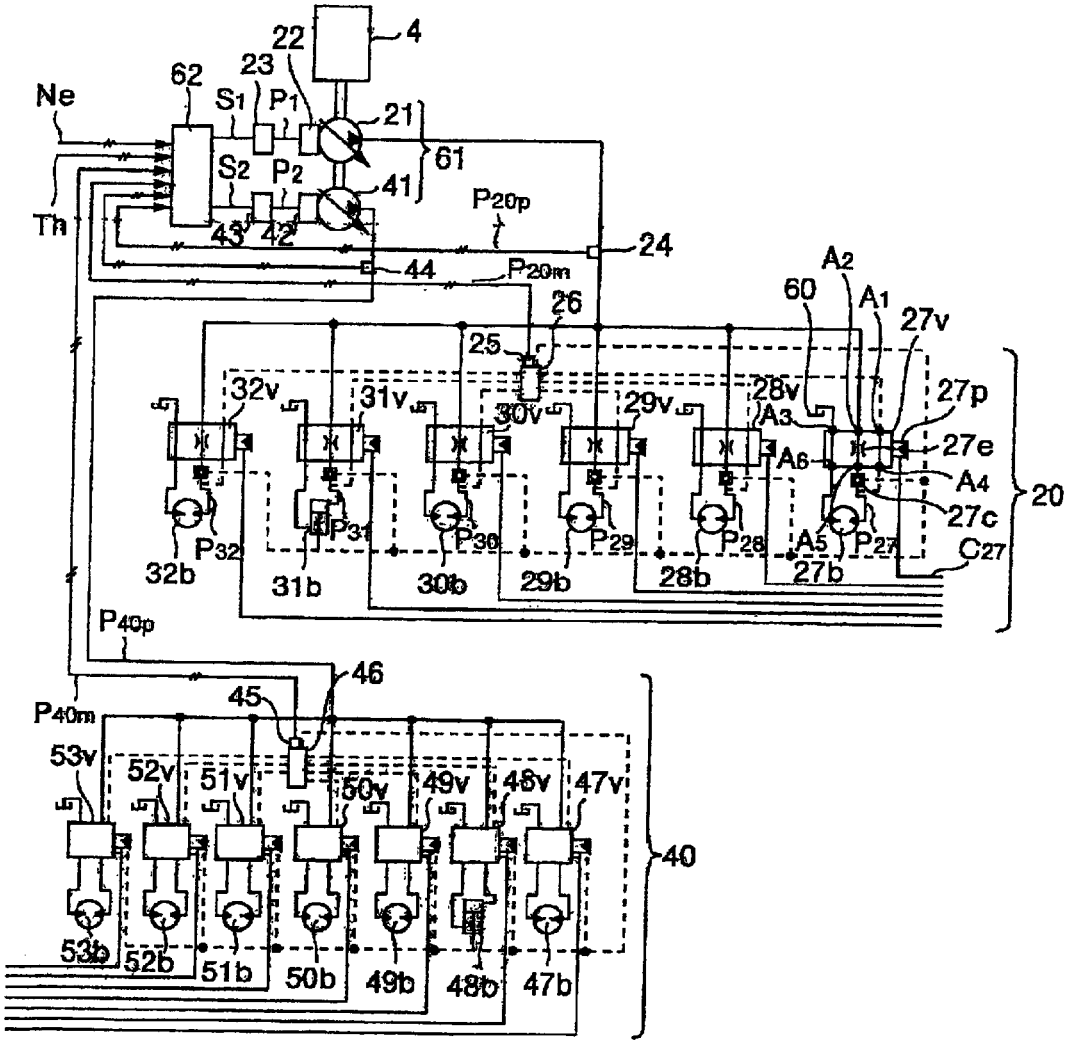
FIG. 4 is a hydraulic circuit diagram of mixers and working machines according to a second embodiment.

Mixers 27, 28, 29 and 47, and all the working machines 30, 31, 32, 48, 49, 50, 51, 52 and 53 are driven by respective hydraulic actuators. Based on FIG. 4, a constitution of a hydraulic circuit driven by an engine 4 and controlling the hydraulic actuators will be explained.

A tandem pump 61 driven by the engine 4 has a first pump 21 and a second pump 41, which are hydraulic pumps. A first circuit 20 into which pressure oil of the first pump 21 flows is a circuit with a first, second and third rotary hammer valves 27*v*, 28*v* and 29*v*, a feed conveyor valve 30*v*, a crane valve 31*v* and a vibrating sieve valve 32*v* as main elements. A second circuit 40 into which pressure oil of the second pump 41 flows is a circuit with a soil cuter valve 47*v*, a solidifying material feeder valve 48*v*, a raking rotor valve 49*v*, a discharge belt conveyor valve 50*v*, a secondary belt conveyor valve 51, a tertiary belt conveyor valve 52*v* and an air compressor valve 53*v* as main elements. It should be noted that the first pump 21 and the second pump 41 may not be tandem, but may be separately driven by the engine 4.

The first pump 21 and the second pump 41 are variable displacement pumps discharge flow rates of which are changed according to angles of swash plates. The swash plate angles are controlled by a first servo valve 22 and a second servo valve 42, respectively. The first servo valve 22 and the second servo valve 42 are controlled by first pilot oil pressure P1 and second pilot oil pressure P2 respectively outputted from a first pressure valve 23 and a second pressure valve 43 for generating pilot pressure according to inputted electrical signals.

First, a constitution of the first circuit 20 will be explained. The explanation is made easier by showing the state in which each of the first, second, third rotary hammer valves 27*v*, 28*v* and 29*v*, the feed conveyor valve 30*v*, the crane valve 31*v* and the vibrating sieve valve 32*v* has a valve opening degree, and each of actuators 27*b*, 28*b*, 29*b*, 30*b*, 31*b* and 32*b* corresponding to each of the valves 27*v*, 28*v*, 29*v*, 30*v*, 31*v* and 32*v* is moving in a certain direction.

The explanation is made with the first rotary hammer valve 27*v* take as an example. A first rotary hammer valve oil pressure signal C27, which is issued from an operating lever and the like not shown, is inputted into a first rotary hammer valve pressure receiving part 27*p*, and the first rotary hammer valve 27*v* is moved in an opening degree position corresponding to a magnitude of the first rotary hammer valve oil pressure signal C27. A pipe line from the first pump 21 is connected to a port A2 of the first rotary hammer valve 27*v*, and the port A2 communicates with a port A5 via a restrictor 27*e*. An area of the restrictor 27*e* changes according to the magnitude of the first rotary hammer valve oil pressure signal C27. When the magnitude of the first rotary hammer valve oil pressure signal C27 is zero, the area of the restrictor 27*e* also becomes zero, whereby discharge oil of the first pump 21 cannot pass through the first rotary hammer valve 27*v*.

The port A5 communicates with one port of the first rotary hammer motor 27*b* via a pressure compensation valve 27*c* the reduction amount of which is changed based on inputted oil pressure. A load pressure P27 of the first rotary hammer motor 27*b* is inputted into a first pressure selection valve 26 via ports A4 and A1 of the first rotary hammer valve 27*v*. Load pressures P28, P29, P30, P31 and P32 at output sides of the second and third rotary hammer valves 28*v* and 29*v*, the feed conveyor valve 30*v*, the crane valve 31*v* and the vibrating sieve valve 32*v* are respectively inputted into the first pressure selection valve 26. The first pressure selection valve 26 selects a first load pressure P20*m* with the highest oil pressure from a plurality of inputted oil pressures, and outputs the selected first load pressure P20*m* to the pressure compensation valves 27*c*, 28*c*, 29*c*, 30*c*, 31*c* and 32*c*. The other port of the first rotary hammer motor 27*b* communicates with a tank 60 via ports A6 and A3 of the first rotary hammer valve 27*v*.

Next, a constitution of the second circuit 40 will be explained. Inner circuits of the soil cutter valve 47*v*, the solidifying material feeder valve 48*v*, the raking rotor valve 49, the discharge belt conveyor valve 50*v*, the secondary belt conveyor valve 51*v*, the tertiary belt conveyor valve 52*v*and the air compressor valve 53*v*, and connection circuits with actuators 47*b*, 48*b*, 49*b*, 50*b*, 51*b*, 52*b* and 53*b* are the same as the first rotary hammer valve 27*v*, and therefore the explanation thereof will be omitted.

The load pressures P47, P48, P49, P50, P51, P52 and P53 of the actuators are inputted into a second pressure selection valve 46. The second pressure selection valve 46 selects a second load pressure P40*m* with the highest hydraulic pressure from a plurality of inputted hydraulic pressures, and outputs the selected second load pressure P40*m* to each of the pressure compensation valves (not shown) of each of the valves.

Next, an input and output signal of a pump controller 62 for controlling a discharge flow rate of the tandem pump 61 will be explained. First discharge pressure P20*p* detected by a first discharge pressure detector 24 attached at a discharge port of the first pump 21, and the first load pressure P20*m* detected by a first load pressure detector 25 are inputted into the pump controller 62. Second discharge pressure P40*p* detected by a second discharge pressure detector 44 attached at a discharge port of the second pump 41, and second load pressure P40*m* detected by a second load pressure detector 45 are inputted into the pump controller 62. An engine speed Ne and a throttle command value Th detected by a detector not shown are also inputted therein. A first signal S1 and a second signal S2 are outputted to the first pressure valve 23 and the second pressure valve 43 from the pump controller 62.

Here, a processing content of the pump controller 62 will be explained. From the first discharge pressure P20*p* and the first load pressure P20*m*, a pressure difference of them will be computed. The first signal S1 that makes the computed pressure difference a predetermined value set in advance is outputted to the first pressure valve 23. This is called pressure difference control means in the pump controller 62. A swash plate angle of the first pump 21 is controlled by the pressure difference control means so that a pressure difference between the largest value out of the load pressures P27, P28, P29, P30, P31 and P32 of the actuators, and the first discharge pressure P20*p* is substantially fixed at a predetermined value. From the second discharge pressure P40*p* and the second load pressure P40*m*, a pressure difference thereof is computed, and the second signal S2 is outputted to the second pressure valve 43 so that the computed pressure difference is substantially fixed. A swash plate angle of the second pump 41 is controlled in the same manner as the first pump 21.

Figure 5:
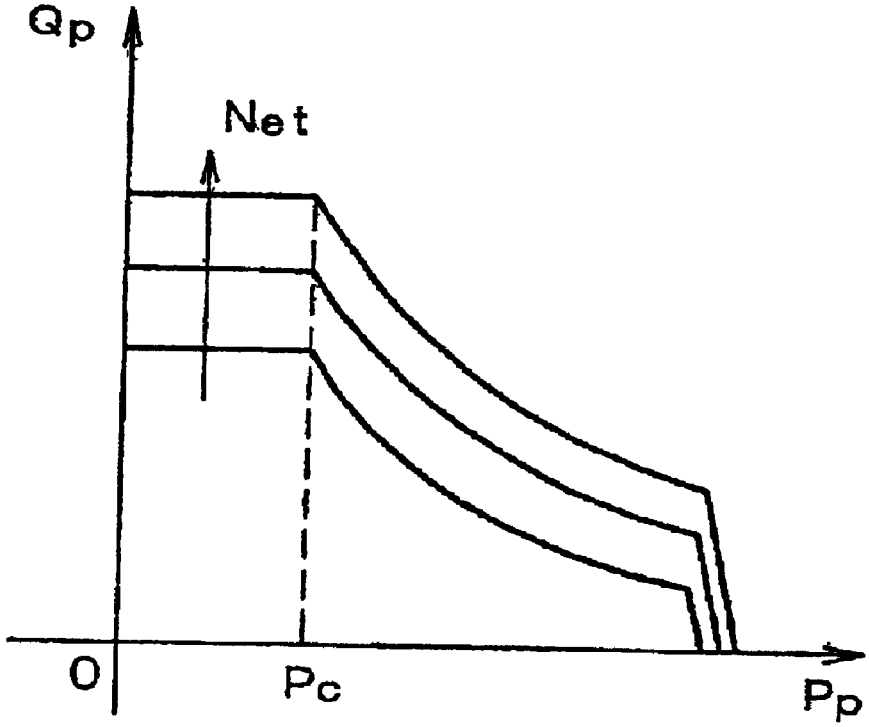
FIG. 5 is an explanatory diagram of relationship between hydraulic pump discharge flow and hydraulic pump load pressure according to the second embodiment.

When a hydraulic pump discharge flow rate Qp enters the vertical axis and load pressure Pp to the hydraulic pump enters the horizontal axis as shown in FIG. 5, the swash plate angle is controlled by the pump controller 62 so that pump output horsepower becomes constant when the load pressure Pp is larger than predetermine pressure Pc. When the load pressure Pp is the predetermined pressure Pc or lower, the maximum value of the swash plate angle of the hydraulic pump is restricted at a fixed value, and the maximum value of the hydraulic pump discharge flow rate Qp is a fixed value corresponding to the engine speed Ne. Since relief pressure for each circuit is set so that the load pressures of the first circuit 20 and the second circuit 40 are always the predetermined pressure Pc or lower, the maximum value of the discharge flow rates of each of the first and second pumps 21 and 41 always become the value corresponding to the engine speed Ne.

Here, an operation of the first circuit 20 will be explained as a representative example. The situation in which the crane 31 and the vibrating sieve 32 stop operating, and the first, second, third rotary hammers 27, 28 and 29 and the feed belt conveyor 30 are operated will be explained. It is assumed that the same load is exerted on all of the first, the second and the third rotary hammers 27, 28 and 29, and the first rotary hammer 27 will be explained as a representative example. The discharge oil of the first pump 21 flows into the first rotary hammer valve 27*v* and the feed belt conveyor valve 30*v* to rotate the first rotary hammer motor 27*b* and the feed belt conveyor motor 30*b*. When the areas of the restrictor 27*e* and a restrictor 30 *e* are the same and the first rotary hammer load pressure P27 and the feed belt conveyor load pressure P30 are equal, the same flow is flowing into each of the first rotary hammer valve 27*v* and the feed belt conveyor valve 30*v*. In this situation, the first load pressure P20*m* is the first rotary hammer load pressure P27 or the feed belt conveyor load pressure P30, and the swash plate angle is controlled so that the first discharge pressure P20*p* becomes a value higher than the first load pressure P20*m* by a predetermined value.

When the load on the first rotary hammer 27 becomes larger and the first rotary hammer load pressure P27 becomes higher than the feed belt conveyor load pressure P30, the first discharge pressure P20*p* becomes higher and the flow passing through the restrictor 30*e* of the feed belt conveyor valve 30 is to increase. In this situation, the first pressure selection valve 26 selects the first rotary hammer load pressure P27 as the first load pressure P20*m*, and supplies it to the pressure compensation valve 30*c*. Then, the opening area of the pressure compensation valve 30*c* becomes smaller and restricted, and thus the flow passing through the restrictor 30*e* does not increase and maintains the same flow as that passing through the restrictor 27*e*.

Further, since the first load pressure P20*m* becomes higher, the predetermined pressure difference held between the first discharge pressure P20*p* and the first load pressure P20*m* becomes smaller. The pump controller 62 computes the first signal S1 to provide the predetermined pressure difference, and outputs it to the first pressure valve 23 to increase the discharge flow of the first pump 21 via the first servo valve 22. In this way, when one hydraulic pump drives a plurality of actuators via a plurality of valves, controlled flow rates corresponding to the individual valve opening degrees are always secured without being influenced by the operation of the other valves even when loads on the individual hydraulic actuators differ.

The explanation will return to the constitution of the engine speed controller 19 shown in FIG. 3. Required flow rate operation tables shown in FIG. 6A and FIG. 6B are stored in a required flow rate operation part 12 in advance. In the operation tables, the required flow rate is expressed by symbols combining "a" to "h" with "1" to "9" as "a138 to "a9". FIG. 6A or FIG. 6B shows the required flow rate of each of the actuators of the first circuit 20 or the second circuit 40 according to the working mode signals H, M, L and S from the working mode setting means 8. It also shows the required flow rates when the operation signals Sc, Sn, Sg, Sk, Sh, Sv, S2, S3 and Sa from the buttons 31*s*, 7*s*, 30*s*, 49*s*, 50*s*, 32*s*, 51*s*, 52*s*and 53*s* of the actuators are the on signals.

As for the required flow rates of the first, the second and the third rotary hammers 27, 28 and 29, the soil cutter 47 and the solidifying material feeder 48, the values in the columns of the presence of raw soil are taken when the presence and absence signal Su from the raw soil presence and absence switch 17 is on, and when it is off, the values in the columns of the absence of raw soil are taken. The required flow rates of the first, the second and the third rotary hammers 27, 28 and 29 and the soil cutter 47 have the maximum values when the working mode signal is H, and they have smaller values in the order of M, L and S. When the operation signals Sc, Sn, Sg, Sk, Sh, Sv, S2, S3 and Sa are off, the required flow rate of each actuator is at zero value, but it is not shown in FIG. 6A and FIG. 6B.

A first flow rate Q1 and a second flow rate Q2 necessary for the first circuit 20 and the second circuit 40 are computed in the required flow rate operation part 12 based on the tables in FIG. 6A and FIG. 6B, and larger one of the first and second flow rates Q1 and Q2 is selected as a large flow rate Q in a large flow rate operation part 13. The engine speed Ne at which the flow rate Q can be sufficiently discharged is computed in an engine speed operation part 14 based on a control curve Ce shown in FIG. 7.

Figure 7:
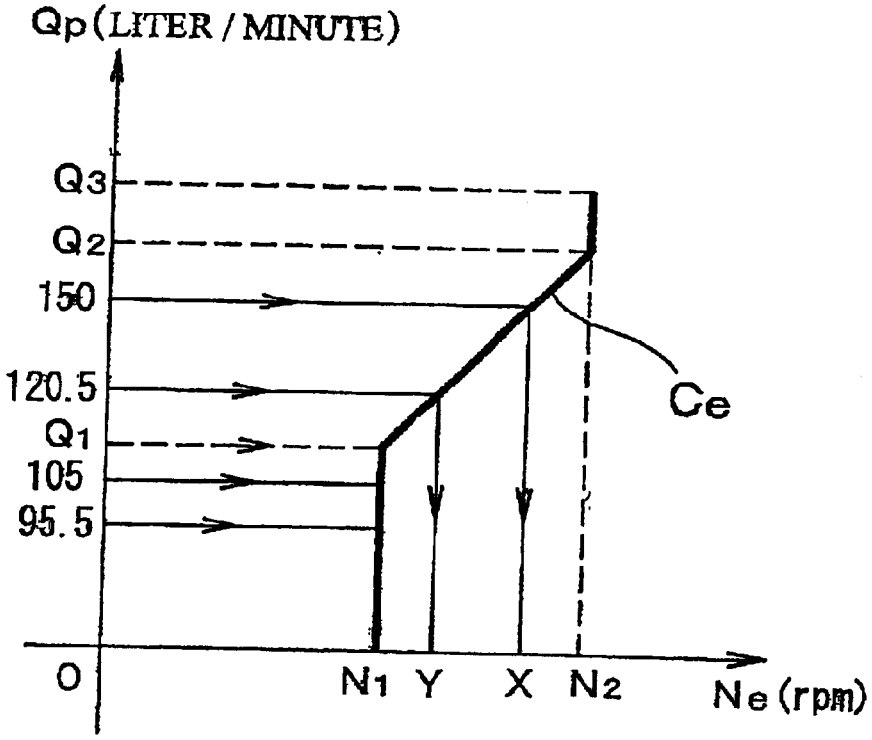
FIG. 7 is an explanatory diagram of an engine control curve according to the second embodiment.

As shown in FIG. 7, when the engine speed Ne is a predetermined first speed N1, the hydraulic pump discharge flow rate Qp changes from zero value to Q1, and when the engine speed Ne is a predetermined second speed N2, the hydraulic pump discharge flow rate Qp changes from Q2 to Q3. When the engine speed Ne is the speed between the first and second speeds, the hydraulic pump discharge flow rate Qp takes the value between the Q1 and Q2. The first speed N1 and the second speed are, for example, 1400 rpm and high idling speed.

A throttle command value Thp corresponding to the engine speed Ne obtained in the engine control curve Ce is computed in a throttle command value operation part 15, and the computed throttle command value Thp is inputted into the governor control means 11.

An operation and effects of the engine speed controller 19 including the above constitution will be explained. Assume that the automatic control button 10 is turned on, the crane button 31*s* attached at the crane 31, the vibrating sieve button 32*s*, the secondary and the tertiary belt conveyor buttons 51*s* and 52*s*, and air compressor button 53*s* that are on the operating panel 5 are turned off, and the working mode signal M is selected in the working mode setting means 8. Also assume that soil is carried on the feed belt conveyor 30, and the presence and absence signal Su of the raw soil presence and absence switch 17 outputs an on signal.

In the required flow rate operation part 12, the first flow rate Q1 is calculated to be, for example, 150 liter/minute by totaling the required flow rates b1, b3 and b5 of the first, the second and the third rotary hammers 27, 28 and 29 with the presence of raw soil and the required flow rate b7 of the feed belt conveyor 30 in the column of M of the first circuit 20 group shown in FIG. 6A. The second flow rate Q2 is calculated to be, for example, 91 liter/minute by totaling the required flow rates f1 and f3 of the soil cutter 47 and the solidifying material feeder 48 with the presence of raw soil, the required flow rate f5 of the raking rotor 49 and the required flow rate f6 of the discharge belt conveyor 50 in the column of M of the second circuit 40 group shown in FIG. 6B.

In the large flow rate selection part 13, the larger flow rate of 150 liter/minute is selected as the large flow rate Q from the first and second flow rates Q1 and Q2. Next, in the engine speed operation part 14, the engine speed Ne corresponding to the large flow rate Q of 150 liter/minute is computed as X rpm from the engine control curve Ce shown in FIG. 7. In the throttle command value operation part 15, the throttle command value Thp corresponding to X rpm is computed and outputted to the governor 11, whereby the engine speed Ne is maintained at X rpm and the discharge flow rates of the first and the second pumps 21 and 41 are maintained at 150 liter/minute.

When soil is not carried on the feed belt conveyor 30, and the presence and absence signal Su of the raw soil presence and absence switch 17 is off, in the required flow rate operation part 12, the first flow rate Q1 is calculated to be, for example, 105 liter/minute by totaling the required flow rates b2, b4 and b6 of the first, the second and the third rotary hammers 27, 28 and 29 with the absence of raw soil and the required flow rate b7 of the feed belt conveyor 30 in the column of M of the first circuit 20 group shown in FIG. 6A. The second flow rate Q2 is calculated to be, for example, 51 liter/minute by totaling the required flow rates f2 and f4 of the soil cutter 47 and the solidifying feeder 48 with the absence of raw soil, the required flow rate f5 of the raking rotor 49 and the required flow rate f6 of the discharge belt conveyor 50 in the column of M of the first circuit 40 group shown in FIG. 6B.

In the large flow rate selection part 13, the larger flow rate of 105 liter/minute is selected as the large flow rate Q from the first and the second flow rates Q1 and Q2. Next, in the engine speed operation part 14, the engine speed corresponding to the large flow rate Q of 105 liter/minute is computed to be N1 rpm from the engine control curve Ce shown in FIG. 7. In the throttle command value operation part 15, the throttle command value Thp corresponding to N1 rpm is computed and outputted to the governor control means 11, whereby the engine speed Ne is maintained at N1 rpm and the discharge flow rates of the first and the second pumps 21 and 41 are each maintained to be 105 liter/minute.

Assume that the automatic control button 10 is turned on, and the vibrating sieve button 32*s*, the air compressor button 53*s* and the crane button 31*s* on the operating panel 5 are turned off, the secondary and the tertiary belt conveyor buttons 51*s* and 52*s* are turned on, and the working mode signal S is selected in the working mode setting means 8. Also assume that soil is carried on the feed belt conveyor 30, and the presence and absence signal Su of the raw soil presence and absence switch 17 outputs an on signal.

In the required flow rate operation part 12, the required flow rate of the first circuit 20 group is calculated to be, for example, 105.5 liter/minute from FIG. 6A, and the required flow rate of the second circuit 40 group is calculated to be, for example, 120.5 liter/minute, respectively. In the large flow rate selection part 13, the larger flow rate of 120.5 liter/minute is selected as the large flow rate Q from the first and second flow rates Q1 and Q2, and the engine speed corresponding to the flow rate of 120.5 liter/minute is computed to be Y rpm from the engine control curve Ce shown in FIG. 7. The throttle command value operation part 15 computes the throttle command value Thp corresponding to Y rpm and outputs it to the governor control means 11 to maintain the engine speed Ne at Y rpm and maintain the discharge flow rates of the first and the second pumps 21 and 41 at 120.5 liter/minute.

When soil is not carried on the feed belt conveyor 30 and the presence and absence signal Su of the raw soil presence and absence switch 17 is an off signal, in the required flow rate operation part 12, the required flow rate of the first circuit 20 group is totaled to be, for example, 77 liter/minute from FIG. 6A, and the required flow rate of the second circuit 40 group is totaled to be, for example, 95.5 liter/minute from FIG. 6B. In the large flow rate selection part 13, the larger flow rate of 95.5 liter/minute is selected as the large flow rate Q from the first and second flow rates Q1 and Q2, and the engine speed Ne corresponding to the flow rate of 95.5 liter/minute is computed to be N1 rpm from the engine control curve Ce shown in FIG. 7. The throttle command value operation part 15 computes the throttle command value Thp corresponding to N1 rpm and outputs it to the governor control means 11 to maintain the engine speed Ne at N1 rpm and maintain each of the discharge flow rates of the first and the second pumps 21 and 41 at 95.5 liter/minute.

When the automatic control button 10 is turned on, and all the buttons 31*s*, 7*s*, 30*s*, 49*s*, 50*s*, 32*s*, 51*s*, 52*s* and 53*s* of the working machines are turned off, the engine speed Ne is controlled at a decelerating speed (for example, low idling speed of 600 rpm).

As described above, the pump required flow rate is computed based on the operation signals Sc, Sn, Sg, Sk, Sh, Sv, S2, S3 and Sa from the buttons 31*s*, 7*s*, 30*s*, 49*s*, 50*s*, 32*s*, 51*s*, 52 and 53*s* for commanding activation and deactivation of the respective actuators, the working mode signals H, M, L and S from the working mode setting means 8 and the presence and absence signal Su from the raw soil presence and absence switch 17. Subsequently, the engine speed Ne is controlled at a rotational speed corresponding to the pump required flow rate. Thereby, when the pump required flow rate is small, the engine speed Ne is automatically and finely controlled to be lower, and therefore the engine speed controller 19 for the soil modifying machine, which reduces noise and vibration of the engine and has excellent fuel economy, can be obtained.

In the second embodiment, the explanation is made with the mobile soil modifying machine 1 taken as an example, but as in the first embodiment, it is obvious that the same effects are exhibited with a stationary soil modifying machine instead of a mobile type. In the second embodiment, the engine speed Ne is controlled at a decelerating speed when all the working machine buttons 31*s*, 7*s*, 30*s*, 49*s*, 50*s*, 32*s*, 51*s*, 5*s* and 53*s* are turned off, but this is not restrictive, and the engine speed Ne may be controlled at a decelerating speed when, for example, only the mixer button 7*s* is turned on.

As explained thus far, according to the present invention based on the second embodiment, i) operation means for outputting operating signals to activate and deactivate the mixers and respective peripheral working machines, ii) a tandem pump driven by the engine and having a plurality of hydraulic pumps for supplying pressure oil to each of a plurality of groups into which a plurality of hydraulic actuators for driving the mixers and the peripheral working machines are divided, iii) governor control means for controlling engine speed based on an inputted command value, and iv) a controller for totaling pressure oil flow rates necessary for the hydraulic actuators operated according to the operation signal based on the operation signal outputted from the operation means, computing the command value corresponding to the engine speed corresponding to the required flow rate with the larger totaled value, and outputting it to the governor control means are included. As a result, each of the hydraulic pumps can secure the flow rate required by each of the groups, and therefore the mixers and the peripheral working machines desired to operate can be surely operated. Since the engine speed is controlled according to the kinds of the mixers and working machines to be operated, the engine speed controller for the soil modifying machine with noise and vibration being reduced with excellent fuel economy can be obtained. Since the engine speed can be automatically controlled to be higher or lower according to the number of working machines under operation, the operation of the operator is facilitated, and thus the soil modifying machine having excellent operation feeling can be provided.

What is claimed is:

1. Mixing equipment having a rotational speed controller for a soil modifying machine for mixing and modifying soil to be modified, comprising:

a mixer rotating to mix soil to be modified;

drive means for rotationally driving said mixer;

speed control means for controlling rotational speed of said drive means based on an inputted rotational speed command value;

working mode setting means for outputting a working mode signal for setting a desired grain diameter of modified soil in accordance with a kind of soil to be modified;

and a controller for outputting the rotational speed command value corresponding to the working mode signal to said speed control means.

2. Mixing equipment having a rotational speed controller for the soil modifying machine according to claim 1, wherein a plurality of said mixers are included; and wherein said controller controls rotational speeds of a plurality of said mixers according to the rotational speed command values corresponding to the individual working mode signals of a plurality of said mixers.

3. Mixing equipment having a rotational speed controller for the soil modifying machine according to claim 2, wherein a plurality of said mixers comprise a rotary cutting mixer for mixing soil to be modified with a cutter for cutting it, and a rotary impact mixer for mixing soil to be modified by giving it an impact with a hammer.

4. Mixing equipment having a rotational speed controller for the soil modifying machine, comprising:

a mixer to mix soil to be modified;

drive means for rotationally driving said mixer;

speed control means for controlling rotational speed of said drive means based on an inputted rotational speed command value;

working mode setting means for outputting a working mode signal for setting a kind of soil to be modified; and a controller for outputting the rotational speed command value corresponding to the working mode signal to said speed control means, wherein said working mode setting means comprises a plurality of selection switches for setting the kind of soil to be modified.

5. Mixing equipment having a rotational speed controller for the soil modifying machine according to claim 4, wherein said controller has a rotational speed table in which the rotational speed command values of said mixer corresponding to a plurality of said selection switches are previously stored, and outputs the rotational speed command value, which is obtained from said rotational speed table correspondingly to any selected switch out of a plurality of said selection switches, to said speed control means.

6. Mixing equipment having a rotational speed controller for the soil modifying machine, comprising:

a mixer to mix soil to be modified;

drive means for rotationally driving said mixer;

speed control means for controlling rotational speed of said drive means based on an inputted rotational speed command value;

working mode setting means for outputting a working mode signal for setting a kind of soil to be modified; and a controller for outputting the rotational speed command value corresponding to the working mode signal to said speed control means, wherein a plurality of said mixers are included, wherein said controller controls rotational speeds of a plurality of said mixers according to the rotational speed command values corresponding to the individual working mode signals of a plurality of said mixers and wherein said working mode setting means comprises a plurality of selection switches for setting the kind of soil to be modified.

7. Mixing equipment having a rotational speed controller for the soil modifying machine according to claim 6, wherein said controller has a rotational speed table which the individual rotational speed command values of a plurality of said mixers corresponding to a plurality of said selection switches are previously stored, and outputs the rotational speed command values, which are obtained from said rotational speed table correspondingly to any selected switch out of a plurality of said selection switches, to said speed control means.

8. Mixing equipment having an engine speed controller for a soil modifying machine, comprising:

mixers for mixing soil to be modified and at least one of working machines for mixing around said mixers, which are provided at said soil modifying machine;

operation means for outputting operation signals to activate and deactivate said mixers and each of said working machines;

a pump having a plurality of hydraulic pumps for supplying pressure oil to each of a plurality of groups into which a plurality of hydraulic actuators driving said mixers and said working machines are divided, and driven by an engine;

governor control means for controlling engine speed based on an inputted command value; and a controller for totaling hydraulic oil flow rates required by said hydraulic actuators operated based on said operation signals according to a plurality of said groups, computing a command value corresponding to the engine speed according to a maximum required flow rate out of said totaled values, and outputting it to the governor control means.

9. Mixing equipment having an engine speed controller for the soil modifying for the soil modifying machine according to claim 8, further comprising:

working mode setting means for outputting a working mode signal for setting a kind of soil to be modified, wherein when totaling required hydraulic oil flow rates according to a plurality of said groups, said controller totals them based on said working mode signal and said operation signals.

10. Mixing equipment having an engine speed controller the soil modifying machine, comprising:

mixers for mixing soil to be modified and working machines other than said mixers, which are provided at said soil modifying machine;

operation means for outputting operation signals to activate and deactivate at least said mixers of said soil modifying machine;

an engine for supplying driving power for at least said mixers of said soil modifying machine;

governor control means for controlling engine speed based on an inputted command value; and a controller for outputting command values based on said operation signals to said governor control means; and working mode setting means for outputting a working mode signal for setting a kind of soil to be modified, wherein said controller computes a command value to said governor control means according to said working mode signal and said operation signals.

11. Mixing equipment having an engine speed controller for a soil modifying machine, comprising:

mixers for mixing soil to be modified and at least one of working machines for mixing around said mixers, which are provided at said soil modifying machine;

operation means for outputting operation signals to activate and deactivate said mixers and each of said working machines;

a pump having a plurality of hydraulic pumps for supplying pressure oil to each of a plurality of groups into which a plurality of hydraulic actuators driving said mixers and said working machines are divided, and driven by an engine; working mode setting means for outputting a working mode signal for setting a kind soil to be modified; governor control means for controlling engine speed based on an inputted command value; and a controller for previously storing an engine control curve expressing relationship between discharge flow rates of a plurality of said hydraulic pumps and engine speed, wherein said controller totals pressure oil flow rates required by said hydraulic actuators corresponding to said working mode signal and said operation signals according to a plurality of said groups, obtains engine speed corresponding to a maximum required flow rate out of said totaled values from said engine control curve, and outputs a command value corresponding to said obtained engine speed to said governor control means.

12. Mixing equipment having an engine speed controller for the soil modifying machine according to any one of claim 10, claim 9, and claim 11, wherein said working mode setting means has a plurality of selection switches corresponding to said working mode signals.

13. Mixing equipment having an engine speed controller a soil modifying or mixing and modifying soil to be modified, comprising:

a plurality of mixers including a first mixer and a second mixer rotating to mix soil to be modified;

drive means for rotationally driving said plurality of mixers;

speed control means for controlling rotational speed of said drive means based on an inputted rotational speed command value;

working mode setting means for outputting a working mode signal for setting a kind of soil to be modified; and a controller for outputting the rotational speed command value corresponding to the working mode signal to said speed control means, wherein said controller controls rotational speeds of said plurality of said mixers according to the rotational speed command values corresponding to the individual working mode signals of a plurality of said mixers and is operative to control rotational speed of the first mixer according to one of an operational speed state and a low speed state being lower in rotational speed than the operational speed state regardless of the outputted working mode signal.

14. Mixing equipment having an engine speed controller the soil modifying machine according to claim 13, wherein the first mixer is a rotary cutting mixer for mixing soil to be modified with a cutter for cutting it, and the second mixer is a rotary impact mixer for mixing soil to be modified by giving it an impact with a hammer.

* * * * *

UNITED STATES PATENT AND TRADEMARK OFFICE

CERTIFICATE OF CORRECTION

PATENT NO. : 6,811,300 B2
DATED : November 2, 2004
INVENTOR(S) : Yasuhiro Kamoshida et al.

It is certified that error appears in the above-identified patent and that said Letters Patent is hereby corrected as shown below:

Column 17,
Line 66, "for the soil modifying for the soil modifying" should read -- for the soil modifying --.

Signed and Sealed this

Twenty-ninth Day of March, 2005

JON W. DUDAS
*Director of the United States Patent and Trademark Office*